United States Patent [19]

Machenschalk et al.

[11] 4,090,103

[45] May 16, 1978

[54] X-RAY TARGET

[75] Inventors: Rudolf Machenschalk; Hubert Bildstein, both of Reutte, Austria

[73] Assignee: Schwarzkopf Development Corporation, New York, N.Y.

[21] Appl. No.: 667,466

[22] Filed: Mar. 16, 1976

[30] Foreign Application Priority Data

Mar. 19, 1975 Austria ..... 2120/75

[51] Int. Cl.[2] ..... H01J 35/08

[52] U.S. Cl. ..... 313/330; 252/520; 313/311; 427/34; 427/423

[58] Field of Search ..... 313/330, 311; 252/520; 427/34, 423

[56] References Cited

U.S. PATENT DOCUMENTS

| | | | |
|---|---|---|---|
| B 504,056 | 2/1976 | Magendans et al. | 313/330 |
| 3,700,950 | 10/1972 | Michitaka | 313/330 |
| 3,836,807 | 9/1974 | Schreiner et al. | 313/330 |
| 3,919,124 | 11/1975 | Friedel et al. | 313/330 |
| 4,029,829 | 6/1977 | Bildstein et al. | 313/330 |

*Primary Examiner*—Saxfield Chatmon, Jr.

*Attorney, Agent, or Firm*—Morgan, Finnegan, Pine, Foley & Lee

[57] ABSTRACT

An X-ray target, preferably a rotating target is disclosed in which at least part of the target surface outside the focal area contains a coating layer of a mixture composed of molybdenum, tungsten, niobium or tantalum, and from 20–60 volume percent of a ceramic oxide.

13 Claims, 1 Drawing Figure

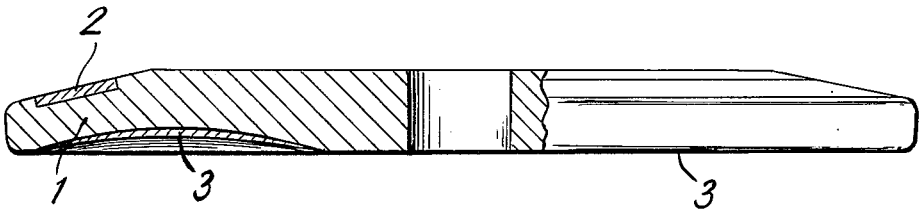
2
1
3
3

X-RAY TARGET

The present invention relates to an X-ray target, particularly a rotating target, made of refractory metals and equipped with a high thermal emission coating on its surface outside the focal area. Only about one percent of the kinetic energy of high-velocity electrons which impringe on the target is transformed into X-ray energy. The remainder is transformed into heat which must be removed from the target by heat conduction and radiation. The equilibrium temperature profile in the X-ray target is determined by the amount of heat generated, the thermal-conduction and radiation conditions.

The high X-ray energy densities required in modern X-ray techniques result in correspondingly large heat outputs. Refractory metals with a high specific heat and good thermal conductivity, particularly molybdenum, tungsten and their alloys, are used as base materials for high-duty targets, particularly rotating targets. In the area of the focal track, a tungsten or tungsten-rhenium layer is usually applied over the base material. The temperature attained in modern rotating X-ray targets is only slightly below the melting temperature of the target material so that a further increase in the X-ray yield can be attained only via improved radiative heat dissipation from the target surface. An increase in target size and thus the emitting surface is not practical. The heat removal through heat conduction via the target shaft cannot be further increased because this would cause excessive heating of the bearings.

Various measures have been proposed to increase the thermal emission of target surfaces, from roughening of the surface to different coating materials and methods. Depending on the nature of the substrate material, coating with carbon black or graphite, tantalum and tungsten, tantalum carbide and hafnium carbide and finally ceramic oxides such as $Ti0_2$ and $Al_20_3$ have been proposed. The coating is usually carried out by spraying or brazing or sintering on of metal powders previously applied to the surface by brushing.

For various reasons, however, the aforementioned coating materials have not served the purpose adequately or reliably over long periods of time. Owing to insufficient match between the thermal expansion of substrate and coating, the adhesion of the coating was often inadequate on account of the extreme temperature fluctuations. Coarse-grained coatings exhibited a particularly poor adhesion. Tantalum and tungsten adhere well to other refractory metals but have a relatively low thermal emission compared with other proposed coating materials. In other cases the inadequate bond between substrate and coating impeded heat transfer. In the case of the ceramic oxide coating materials, the relatively low thermal conductivity has limited the heat transfer through the coating.

In accordance with the present invention, an increased thermal emission and reliability of operation compared with previously proposed coatings, is attained by the fact that at least part of target surface outside the focal area is coated with a thin layer of a compound material consisting of molybdenum and/or tungsten and/or niobium and/or tantalum in combination with 20–60 volume percent of a ceramic oxide such as $Ti0_2$ and/or $Al_20_3$ and/or $Zr0_2$. A preferred embodiment of the invention is a 60 micron thick coating of a compound material consisting of 60 volume percent molybdenum and 40 volume percent $Ti0_2$ on the underside of a rotating target made of a molybdenum-5 wt.% tungsten alloy, the upper side of which is covered in the area of the focal track with a tungsten-10 wt.% rhenium alloy.

The invention, in its preferred embodiment, is more fully described in connection with the annexed drawing in which:

The FIGURE shows a section of the rotating target of this invention.

In the FIGURE, body 1 is made of a molybdenum-tungsten alloy containing 5% by weight tungsten, and the focal track 2, where the electrons impinge on the target, is formed of a tungsten-rhenium alloy containing 10% by weight rhenium. On the underside of the rotating target is a coating layer 3 made of a mixture material consisting of 60 volume percent molybdenum and 40 volume percent $Ti0_2$, preferably having a coating layer thickness of 60 microns.

The compound materials are applied on the substrate material in a layer thickness of 10–500 microns by known methods such as flame and plasma spraying, with varying particle sizes, e.g., 10–40 microns. In order to prevent a desegregation of the compound material in the coating layer, it is often preferred, instead of applying a mixture of metal and oxide powder, to spray a presintered and then comminuted compound material. The deposition on the target is followed by annealing for 1 hour at 1600° C in a vacuum of about $10^{-4}$ torr or in a hydrogen atmosphere. The color of the coating changes during annealing from light gray to dark anthracite.

When compound materials with a high proportion of metal are sprayed, it is sometimes advantageous to reduce the proportion of metal on the surface of the coating prior to annealing by an etching treatment, using known methods.

Compounds materials disclosed herein have been found to be greatly superior to the previously proposed coating materials with regard to their thermal emission characteristics.

Using the preferred embodiment as an example, it can be shown that the substrate material is continued into the compound material of the coating, which is an important prerequisite for good adhesion. Furthermore, the molybdenum in the compound layer forms a supporting skeleton in which the titanium dioxide is embedded in a practically pore-free manner, which results in an excellent thermal conductivity up to the surface and, at the same time, provides a practically identical thermal expansion of base body and coating, particularly as the thermal expansion of the oxides disclosed herein does not differ greatly from that of the refractory metals.

The darkening of the coating through partial reduction of the oxides during the annealing treatment imparts to the target surface an overall emission coefficient of 0.8, which is only slightly less than that of graphite and greater than that of a pure refractory metal.

The compound materials disclosed herein do not react chemically with the substrate metal. They have a very low vapor pressure and, when niobium and tantalum are used, they have a gettering effect on the residual gas in the X-ray tube. This helps to reduce the risk of metallization of the glass bulb of the tube. By means of the present invention, higher X-ray densities can be achieved without damage to the target. In particular, the risk of warping or cracking of the target through sudden temperature changes is essentially reduced.

It should be understood by those skilled in the art that various modifications may be made in the present invention without departing from the spirit and scope thereof as described in the specification and defined in the appended claims.

What is claimed is:

1. An X-ray target made of a refractory metal having a high thermal emission coating outside the focal area, the improvement comprising having at least part of the target surface outside the focal area equipped with a coating of a mixture material consisting of a substance selected from the group consisting of molybdenum, tungsten, niobium, tantalum and mixtures thereof; and 20 to 60 volume percent of a ceramic oxide.

2. The X-ray target according to claim 1 wherein said target is a rotating target.

3. The X-ray target according to claim 1 wherein said ceramic oxide is selected from the group consisting of $TiO_2$, $Al_2O_3$, $ZrO_2$ and mixtures thereof.

4. The X-ray target according to claim 1 wherein the coating layer of the mixture material has a thickness of from 10 to 500 microns.

5. The X-ray target according to claim 3 wherein the mixture material consists of 60 volume percent molybdenum and 40 volume percent $TiO_2$ and has a coating layer thickness of 60 microns.

6. The X-ray target according to claim 1 wherein the refractory metal is selected from the group consisting of sintered molybdenum and molybdenum-tungsten alloy.

7. The rotating X-ray target according to claim 2 wherein the mixture material consists of 60 volume percent molybdenum and 40 volume percent $TiO_2$ coated on the underside of the rotating target made of a molybdenum-5 wt.% tungsten alloy, the upper side of the rotating target coated with a tungsten-10 wt.% rhenium alloy in the focal area, said mixture material having a coating layer thickness of 60 microns.

8. A method for producing the X-ray target according to claim 1 which comprises applying the mixture material to the refractory metal in the form of a powder by flame or plasma spraying.

9. The method of claim 8 wherein said powder comprises particles having a particle size in the range from 10 to 40 microns.

10. The method of claim 8 wherein said mixture material is presintered and comminuted prior to application to the refractory metal.

11. The method of claim 8 wherein subsequent to application, the deposited material mixture is annealed.

12. The method of claim 11 wherein said annealing is effected for about 1 hour at a temperature of 1600° C under vacuum or in a hydrogen atmosphere.

13. The method of claim 11 wherein prior to annealing, an etching treatment is effected.

* * * * *